US010173229B2

(12) United States Patent
Dau et al.

(10) Patent No.: US 10,173,229 B2
(45) Date of Patent: Jan. 8, 2019

(54) ELECTROSTATIC ATOMIZING DEVICE

(71) Applicant: SUMITOMO CHEMICAL COMPANY, LIMITED, Tokyo (JP)

(72) Inventors: Van Thanh Dau, Takarazuka (JP); Tibor Terebessy, Wallingford (GB)

(73) Assignee: SUMITOMO CHEMICAL COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/418,294

(22) PCT Filed: Jul. 25, 2013

(86) PCT No.: PCT/JP2013/070204
§ 371 (c)(1),
(2) Date: Jan. 29, 2015

(87) PCT Pub. No.: WO2014/021191
PCT Pub. Date: Feb. 6, 2014

(65) Prior Publication Data

US 2015/0182978 A1 Jul. 2, 2015

(30) Foreign Application Priority Data

Aug. 1, 2012 (JP) ..... 2012-171411

(51) Int. Cl.
*B05B 5/053* (2006.01)
*B05B 5/03* (2006.01)
(Continued)

(52) U.S. Cl.
CPC ..... *B05B 5/03* (2013.01); *B05B 5/025* (2013.01); *B05B 5/0533* (2013.01); *B05B 5/1691* (2013.01); *B05B 15/50* (2018.02)

(58) Field of Classification Search
CPC ..... A61M 13/00; F23D 11/32; B05B 5/00; B05B 3/1092; B05B 3/03; B05B 5/0255;
(Continued)

(56) References Cited

U.S. PATENT DOCUMENTS 5,584,931 A 12/1996 Buhlmann
6,302,331 B1 * 10/2001 Dvorsky ..... A61M 15/02 239/3
(Continued)

FOREIGN PATENT DOCUMENTS

CN 1101305 A 4/1995
CN 101466474 A 6/2009
(Continued)

OTHER PUBLICATIONS

International Preliminary Report on Patentability dated Feb. 12, 2015 issued in Application No. PCT/JP2013/070204.
(Continued)

*Primary Examiner* — Alexander Valvis
*Assistant Examiner* — Christopher R Dandridge
(74) *Attorney, Agent, or Firm* — Foley & Lardner LLP

(57) ABSTRACT

An electrostatic atomizing device includes: a spray electrode and a reference electrode across which and the spray electrode a voltage is applied, the reference electrode being provided near the spray electrode, the spray electrode and the reference electrode being provided in an opening and an opening, respectively, which are provided on a device surface of the electrostatic atomizing device, and the opening being provided so as to reduce a ratio in which an atomized substance adheres to the device surface.

9 Claims, 11 Drawing Sheets

(51) Int. Cl.

| | |
|---|---|
| ***B05B 5/025*** | (2006.01) |
| *B05B 5/16* | (2006.01) |
| *B05B 15/50* | (2018.01) |

(58) Field of Classification Search

CPC ..... B05B 5/087; B05B 5/057; B05B 5/0426; B05B 5/04; B05B 5/03; B05B 5/025; B05B 5/0533; B05B 5/1691; B05B 5/032; B05B 15/02; B05B 15/50; B05B 5/16; B05B 5/0535; A01N 25/06; A61L 9/14; A01M 1/205

USPC ..... 239/690.1, 703, 706, 708, 690–702

See application file for complete search history.

(56) References Cited

U.S. PATENT DOCUMENTS

| | | | | |
|---|---|---|---|---|
| 7,337,993 | B2 * | 3/2008 | Pirrie | A61L 9/14 128/200.12 |
| 2004/0251326 | A1 * | 12/2004 | Pirrie | A61L 9/14 239/690.1 |
| 2006/0131449 | A1 * | 6/2006 | Azukizawa | B05B 5/0255 239/690.1 |
| 2007/0194156 | A1 * | 8/2007 | Pirrie | A61M 15/02 239/690 |
| 2008/0283636 | A1 | 11/2008 | Pirrie | |
| 2009/0184186 | A1 | 7/2009 | Suda et al. | |
| 2010/0258649 | A1 | 10/2010 | Pirrie | |
| 2013/0270371 | A1 | 10/2013 | Pirrie | |
| 2013/0313335 | A1 | 11/2013 | Njatawidjaja et al. | |
| 2014/0151471 | A1 | 6/2014 | Dau et al. | |

FOREIGN PATENT DOCUMENTS

| | | | |
|---|---|---|---|
| JP | 2004-530552 | A | 10/2004 |
| WO | WO-03/000431 | A1 | 1/2003 |
| WO | WO-2006/077389 | A2 | 7/2006 |
| WO | WO-2007/077424 | A1 | 7/2007 |

OTHER PUBLICATIONS

International Search Report and Written Opinion dated Sep. 24, 2013 issued in Application No. PCT/JP2013/070204.

Chinese Office Action issued in corresponding application No. 201380039341.3 dated Mar. 1, 2016 with an English translation.

Extended European Search Report issued in corresponding application No. 13826305.8 dated Mar. 2, 2016.

Office Action issued in Japanese Patent Application No. 2012-171411 dated May 17, 2016.

Office Action issued in Australian Patent Application No. 2013297692 dated Feb. 8, 2017.

* cited by examiner

ELECTROSTATIC ATOMIZING DEVICE

CROSS REFERENCE TO RELATED APPLICATIONS

This application is the National Phase of PCT/JP2013/070204, filed Jul. 25, 2013, which claims priority to Japanese Application No. 2012-171411, filed Aug. 1, 2012.

TECHNICAL FIELD

The present invention relates to an electrostatic atomizing device which allows a reduction in ratio in which an atomized substance adheres to a device surface of the electrostatic atomizing device.

BACKGROUND ART

An atomizing device which sprays a liquid in a container via a nozzle has been widely used in various fields. A known example of such an atomizing device is an electrostatic atomizing device which atomizes and sprays a liquid by Electro Hydrodynamics (EHD). The electrostatic atomizing device forms an electric field near a tip of a nozzle and uses the electric field to atomize and spray the liquid at the tip of the nozzle. Patent Literature 1 is known as a document which discloses such an electrostatic atomizing device.

CITATION LIST

Patent Literature

Patent Literature 1
Japanese Translation of PCT International Application, Tokuhyo, No. 2004-530552 (Publication Date: Oct. 7, 2004)

SUMMARY OF INVENTION

Technical Problem

However, a conventional technique has the following problem.

Generally, an electrostatic atomizing device is configured such that an electric field is formed between two electrodes (a pin and a capillary) by application of a voltage across the electrodes. In this case, the electric field is oriented in a direction in which a pin extends, and thus an atomized substance is easily atomized in the direction in which the pin extends, i.e., in a direction to the electrostatic atomizing device (hereinafter, this phenomenon is referred to as a spray-back). The electrostatic atomizing device whose device surface is wet by the spray-back causes a hand of a user with which hand the electrostatic atomizing device is being held to be wet. The electrostatic atomizing device is sometimes used for, for example, atomization of aromatic oil, a chemical substance for an agricultural product, a medicine, an agricultural chemical, a pesticide, and an air cleaning agent. Thus, the spray-back to the device surface is preferably smaller.

In this regard, the technique of Patent Literature 1 does not refer to prevention of the spray-back to the device surface.

The present invention has been made in view of the problem, and an object of the present invention is to provide an electrostatic atomizing device which allows a reduction in ratio in which an atomized substance adheres to a device surface of the electrostatic atomizing device.

Solution to Problem

In order to attain the object, an electrostatic atomizing device of the present invention includes: a first electrode and a second electrode across which and the first electrode a voltage is applied, the first electrode for atomizing a substance from a tip thereof, the second electrode being provided near the first electrode, the first electrode and the second electrode being provided in a first opening and a second opening which are provided on a first device surface of device surfaces of the electrostatic atomizing device, respectively, and the second opening being provided so as to reduce a ratio in which the atomized substance adheres to the first device surface.

According to the electrostatic atomizing device of the present invention, the first electrode is provided near the second electrode. The first electrode and the second electrode are provided in the first opening and the second opening, respectively, which are provided on the device surface. The voltage is applied across the first electrode and the second electrode, so that an electric field is formed between the first and second electrodes. The first electrode atomizes a positively charged (or negatively charged) droplet. The second electrode ionizes and negatively charges (or positively charges) air near the second electrode. Then, the negatively charged air moves so as to be away from the second electrode due to the electric field formed between the first and second electrodes and a repulsive force among particles of the negatively charged air. The movement causes a flow of air (hereinafter, the flow may be referred to as an ion stream), and the positively charged droplet is atomized by the ion stream in a direction in which the droplet is away from the electrostatic atomizing device.

In this case, the electric field is oriented in a direction in which the second electrode extends. Therefore, a substance normally is atomized in the direction in which the second electrode extends, i.e., in a direction to the electrostatic atomizing device, so that the atomized substance easily adheres to the device surface (hereinafter, this phenomenon may be referred to as a spray-back).

However, according to the electrostatic atomizing device of the present invention, the second opening is provided so that a ratio in which the atomized substance adheres to the device surface may be reduced. In other words, a shape and a size and the like of the second opening are appropriately adjusted, so that the ratio in which the atomized substance adheres to the device surface is reduced. This makes it possible to prevent the spray-back. Further, in a case where the atomized substance is prevented from adhering to the device surface, a hand of a user does not get wet in holding the electrostatic atomizing device, and the electrostatic atomizing device can have higher portability.

Still further, an electric charge amount of the droplet and a size of the droplet are controllable by use of a change in strength of the ion stream by a change in shape and size of the second opening. The electric charge amount of the droplet and the size of the droplet serve as important factors in determination of an effect of the atomized substance which effect is yielded in use of the electrostatic atomizing device. Thus, the electrostatic atomizing device of the present invention yields an effect of preventing the spray-back and realizing atomization suitable for a purpose of use by controlling the electric charge amount of the droplet and the size of the droplet.

Advantageous Effects of Invention

As described earlier, the electrostatic atomizing device of the present invention is configured such that the first electrode and the second electrode are provided in a first opening and a second opening, respectively, which are provided on a first device surface of device surfaces of the electrostatic atomizing device, and the second opening is provided so as to reduce a ratio in which the atomized substance adheres to the first device surface.

Therefore, the electrostatic atomizing device of the present invention yields an effect of reducing the ratio in which the atomized substance adheres to the device surface.

DESCRIPTION OF EMBODIMENTS

An electrostatic atomizing device 100 or the like of the present embodiment is described below with reference to drawings. In the following description, identical members and components are given respective identical reference signs, and have identical names and identical functions. Thus, detailed descriptions of those members and components are not repeated.

[Configuration of Main Part of Electrostatic Atomizing Device]

Figure 2:
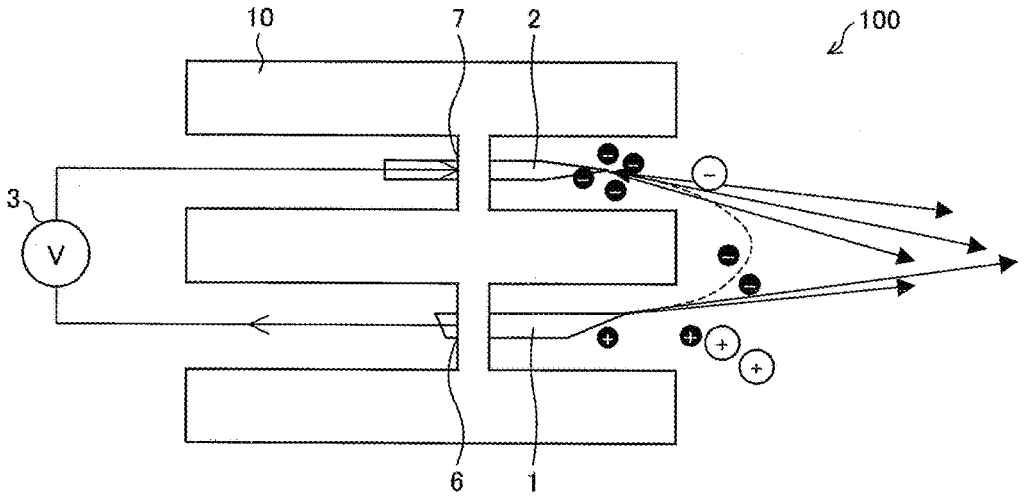
FIG. 2 illustrates a configuration of a main part of another electrostatic atomizing device of the present embodiment.

First, the following description discusses a configuration of a main part of the electrostatic atomizing device 100 with reference to FIG. 2. FIG. 2 illustrates the configuration of the main part of the electrostatic atomizing device 100.

The electrostatic atomizing device 100 is used for, for example, atomization of aromatic oil, a chemical substance for an agricultural product, a medicine, an agricultural chemical, a pesticide, and an air cleaning agent and the like. The electrostatic atomizing device 100 includes at least a spray electrode 1 (a first electrode), a reference electrode 2 (a second electrode), a power supply device 3, and a dielectric 10. Alternatively, the electrostatic atomizing device 100 may be configured such that the power supply device 3 is provided on an outside of the electrostatic atomizing device 100 and the electrostatic atomizing device 100 is connected with the power supply device 3.

The spray electrode 1 includes a conductive conduit such as a metallic capillary (e.g., type 304 stainless steel) and a spray part which is a tip of the spray electrode 1. The spray electrode 1 is connected with the reference electrode 2 via the power supply device 3 and its spray part atomizes a substance to be atomized. Note that the following description simply refers to the substance to be atomized as a "liquid."

The reference electrode 2 is made of a conductive rod such as a metal pin (e.g., type 304 steel pin). The spray electrode 1 and the reference electrode 2 are provided in parallel with each other with a prescribed distance therebetween. The spray electrode 1 and the reference electrode 2 are provided with a distance of, for example, 8 mm therebetween.

The power supply device 3 applies a high voltage across the spray electrode 1 and the reference electrode 2. For example, the power supply device 3 applies a high voltage of 1 kV to 30 kV (e.g., 3-7 kV) across the spray electrode 1 and the reference electrode 2. The application of a high voltage forms an electric field between the electrodes. This causes an electric dipole inside the dielectric 10. In this case, the spray electrode 1 is positively charged, and the reference electrode 2 is negatively charged (alternatively, the spray electrode 1 may be negatively charged, and the reference electrode 2 may be positively charged). Then, a negative dipole occurs on a surface of the dielectric 10 which surface is closest to the positively-charged spray electrode 1, a positive dipole occurs on a surface of the dielectric 10 which surface is closest to the negatively-charged reference electrode 2, so that a charged gas and a charged substance species are released by the spray electrode 1 and the reference electrode 2.

The dielectric 10 is made of a dielectric material such as nylon 6, nylon 11, nylon 12, polypropylene, nylon 66, or a polyacetyl-polytetrafluoroethylene mixture. The dielectric 10 supports the spray electrode 1 at a spray electrode fixing part 6 and supports the reference electrode 2 at a spray electrode fixing part 7.

Figure 3:
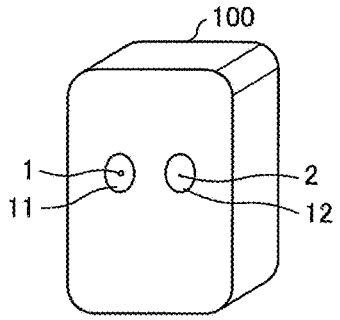
FIG. 3 illustrates an appearance of a further electrostatic atomizing device of the present embodiment.

Next, the following description discusses an appearance of the electrostatic atomizing device 100 with reference to FIG. 3. FIG. 3 illustrates the appearance of the electrostatic atomizing device 100.

As illustrated in FIG. 3, the electrostatic atomizing device 100 is rectangular (or may have another shape). The spray electrode 1 and the reference electrode 2 are provided on a surface of the electrostatic atomizing device 100. As illustrated in FIG. 3, the spray electrode 1 is provided near the reference electrode 2. Further, a circular opening 11 and a circular opening 12 are provided so as to surround the spray electrode 1 and the reference electrode 2, respectively. A voltage is applied across the spray electrode 1 and the reference electrode 2, so that an electric field is formed. The spray electrode 1 atomizes a positively charged droplet. The reference electrode 2 ionizes and negatively charges air near the reference electrode 2. Then, the negatively charged air moves so as to be away from the reference electrode 2 due to the electric field formed between the spray electrode 1 and the reference electrode 2 and a repulsive force among particles of the negatively charged air. The movement causes a flow of air (hereinafter, the flow may be referred to as an ion stream), and the positively charged droplet is atomized by the ion stream in a direction in which the droplet is away from the electrostatic atomizing device 100.

[Configuration for Preventing Spray-back]

The electrostatic atomizing device 100 is configured such that an electric field is formed between the spray electrode 1 and the reference electrode 2 by application of a voltage across the electrodes. In this case, the electric field is oriented in a direction in which a pin extends. Therefore, an atomized liquid is easily atomized in the direction in which the pin extends, i.e., in a direction to the electrostatic atomizing device 100, so that the atomized liquid adheres to a device surface of the electrostatic atomizing device 100 (hereinafter, this phenomenon is referred to as a spray-back). Therefore, it is preferable to prevent (reduce) the spray-back so as to prevent a droplet which is positively charged from adhering to the device surface by an ion stream. Various configurations for preventing the spray-back are described below.

[Size of Opening 12 Around Reference Electrode 2]

An ion stream is generated from the reference electrode 2 by application of a voltage across the spray electrode 1 and the reference electrode 2. The generation of the ion stream causes a reduction in air pressure around the reference electrode 2. Thus, air flows in around the reference electrode 2. Then, the ion stream and inflow air are mixed to cause the ion stream to be a turbulent flow. This turbulent flow may be a cause of the spray-back. In view of this, inventors of the present application consider that the spray-back can be prevented by changing a diameter and a shape of the opening 12 around the reference electrode 2.

Note that in a study below, the reference electrode 2 having a tip with a diameter of less than 0.1 mm and a body with a diameter of 0.5 mm is used. The tip of the reference electrode 2 is preferably sharp, so that negatively charged air easily occurs.

(1) Case where Opening 12 has Increased Diameter

Figure 4:
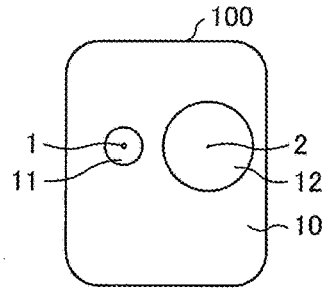
FIG. 4 is a front view of an electrostatic atomizing device having an opening with an increased diameter.

The following description discusses, with reference to FIG. 4, how easily the spray-back occurs in a case where the opening 12 has an increased diameter. FIG. 4 is a front view of the electrostatic atomizing device 100 having the opening 12 with the increased diameter. The ion stream is weakened in a case where the opening 12 has the increased diameter. Thus, a droplet is less likely to be atomized from the electrostatic atomizing device 100, so that the spray-back easily occurs.

Then, it was confirmed to what extent the diameter of the opening 12 can be increased. The confirmation reveals that the ion stream is weakened in a case where the opening 12 has a diameter which is 25 times or more the diameter of the body of the reference electrode 2, or 150 times or more the diameter of the tip of the reference electrode 2, so that inflow air easily flows into the opening 12 via an end of the opening 12. Flow of air into the opening 12 easily causes the ion stream be a turbulent flow. This makes it possible to say that the spray-back is highly likely to occur.

In other words, the spray-back can be less likely to occur by causing the diameter of the opening 12 to be smaller than at least either one of 25 times the diameter of the body of the reference electrode 2 and 150 times the diameter of the tip of the reference electrode 2.

(2) Case where Opening 12 has Decreased Diameter

Figure 5:
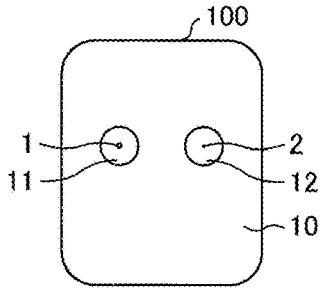
FIG. 5 is a front view of an electrostatic atomizing device having an opening with a decreased diameter.

The following description discusses, with reference to FIG. 5, how easily the spray-back occurs in a case where the opening 12 has a decreased diameter. FIG. 5 is a front view of the electrostatic atomizing device 100 in a case where the opening 12 has a decreased diameter.

A decrease in diameter of the opening 12 causes the ion stream to be strong. However, a part of droplets atomized from the spray electrode 1 in a vertical direction may insufficiently ride the ion stream generated from the reference electrode 2, so that the spray-back may occur. Thus, the opening 12 preferably has a diameter of 1.5 mm to 12.5 mm, i.e., a diameter which is 15 times to 125 times the diameter of the tip of the reference electrode 2, or which is 3 times to 25 times the diameter of the body of the reference electrode 2. Further, the opening 12 preferably has a diameter of 2.5 mm to 4.5 mm, i.e., a diameter which is 25 times to 45 times the diameter of the tip of the reference electrode 2, or which is 5 times to 9 times the diameter of the body of the reference electrode 2. The opening 12 having a diameter falling within an above-described numerical value range allows most of the droplets atomized from the spray electrode 1 to ride the ion stream, so that the spray-back can be prevented.

[Shape of Opening 12 Around Reference Electrode 2]

(1) Case (A) where Opening 12 is Elliptic

Figure 6:
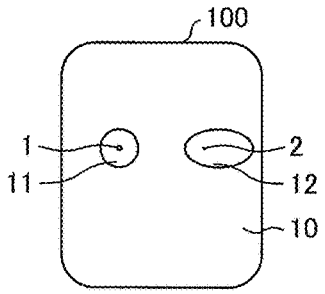
FIG. 6 is a front view of an electrostatic atomizing device having an elliptic opening.

The following description discusses, with reference to FIG. 6, how easily the spray-back occurs in a case where the opening 12 is elliptic. FIG. 6 is a front view of the electrostatic atomizing device 100 in a case where the opening 12 is shaped to have an ellipse. Note that the ellipse of the opening 12 has a long axis which is positioned so as to substantially align with a line segment connecting the reference electrode 2 and the spray electrode 1.

In a configuration of FIG. 6, the ion stream is weak, and additionally, a part of droplets atomized from the spray electrode 1 in a vertical direction insufficiently rides the ion stream, so that the spray-back easily occurs to a right side of FIG. 6 (the reference electrode 2 side).

Thus, the opening 12 which is elliptic as illustrated in FIG. 6 preferably has a width in a short axis direction of 1.5 mm to 12.5 mm. Further, the opening 12 preferably has a width in the short axis direction of 2.5 mm to 4.5 mm, i.e., the width being 25 times to 45 times the diameter of the tip of the reference electrode 2, or being 5 times to 9 times the diameter of the body of the reference electrode 2. Still further, the opening 12 preferably has a width in a long axis direction of 1.5 times to 3.5 times the width in the short axis direction. This allows most of the droplets atomized from the spray electrode 1 to ride the ion stream, so that the spray-back can be prevented.

(2) Case (B) where Opening 12 is Elliptic

Figure 7:
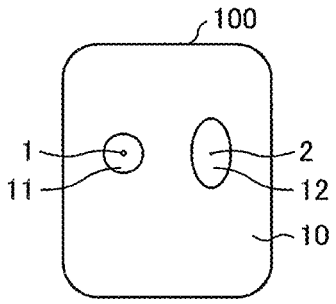
FIG. 7 is a front view of an electrostatic atomizing device having an elliptic opening.

The following description discusses, with reference to FIG. 7, the spray-back in a case where the opening 12 is elliptic. FIG. 7 is a front view of the electrostatic atomizing device 100 in a case where the opening 12 is shaped to have an ellipse. Note that the ellipse of the opening 12 has a short axis which is positioned so as to substantially align with a line segment connecting the reference electrode 2 and the spray electrode 1.

In a configuration of FIG. 7, the ion stream is slow in speed. However, most of the droplets atomized from the spray electrode 1 ride the ion stream, so that the spray-back can be prevented. Strength of the ion stream is optimized by changing the width of the short axis of the ellipse. The ellipse of FIG. 7 and the ellipse described with reference to FIG. 6 may be identical in size of the long axis and the short axis.

(3) Case (C) where Opening 12 is Elliptic

Figure 8:
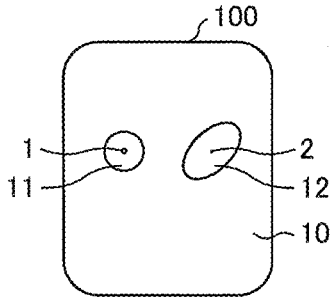
FIG. 8 is a front view of an electrostatic atomizing device having an elliptic opening.

The following description discusses, with reference to FIG. 8, the spray-back in a case where the opening 12 is elliptic. FIG. 8 is a front view of the electrostatic atomizing device 100 in a case where the opening 12 is shaped to have an ellipse. Note that the ellipse of the opening 12 has a long axis and a short axis each of which forms an angle with a line segment connecting the spray electrode 1 and the reference electrode 2.

As illustrated in FIG. 8, the elliptic opening 12 may be positioned to form an angle with the line segment connecting the spray electrode 1 and the reference electrode 2, and the angle can be changed appropriately. In other words, lengths of the long axis and the short axis can be appropriately optimized so that the droplet can be atomized in a direction in which the droplet is away from the electrostatic atomizing device 100.

Further, the opening 12 does not need to be elliptic. Alternatively, the opening 12 may be appropriately designed to have a shape and a size which allow the droplet to ride the ion stream and then be atomized in a direction in which the droplet is away from the electrostatic atomizing device 100. Thus, the openings 12, which are elliptic as illustrated in FIGS. 6 to 8, are merely an example. Alternatively, the openings may have another shape.

The above description has discussed the configuration in which the spray-back is prevented by changing the diameter and the shape of the opening 12 around the reference electrode 2. Note, however, that the electrostatic atomizing device 100 may be configured as below so that the spray-back may be prevented.

For example, the electrostatic atomizing device 100 which is upright may be configured such that the spray electrode 1 and the reference electrode 2 are arranged in a vertical direction or two reference electrodes 2 are arranged on both sides of the spray electrode 1. Alternatively, the electrostatic atomizing device 100 may be configured such that a shape(s) of the spray electrode 1 and/or the reference electrode 2 are/is changed or positive and negative electric charges of the spray electrode 1 and the reference electrode 2 are reversed. Meanwhile, the electrostatic atomizing device 100 may also be configured such that magnetic field generation means is used to atomize the droplet in a direction in which the droplet is away from the electrostatic atomizing device 100.

[Opening for Air Supply]

Figure 9:
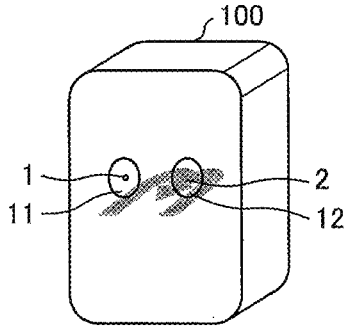
FIG. 9 illustrates flowing in/out of air via an opening around a reference electrode.

Next, the following description discusses a configuration in which the spray-back is prevented by a configuration different from a configuration in which the size and the shape of the opening 12 around the reference electrode 2 are changed. Specifically, a supply of air to the opening 12 around the reference electrode 2 causes the ion stream to be a laminar flow, so that the spray-back is prevented. The following description discusses, with reference to FIG. 9, how to prevent the spray-back. FIG. 9 illustrates flowing in/out of air via the opening 12 around the reference electrode 2. An arrow in FIG. 9 indicates a flow of the air.

Occurrence of the ion stream reduces an air pressure in the vicinity of the opening 12 around the reference electrode 2, so that air flows into a region in which the air pressure has been reduced. In this case, the supply of the air only to the region in the vicinity of the opening 12 causes the ion stream to be a turbulent flow. This may trigger the spray-back.

Figure 1:
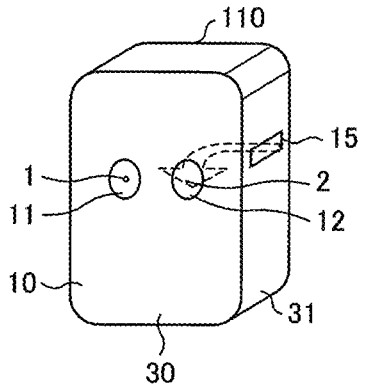
FIG. 1 illustrates a configuration in which an electrostatic atomizing device of the present embodiment has an opening for air supply.

Therefore, the inventors of the present application studied a method in which air is supplied to the opening 12 via an opening different from the opening 12 so as to cause the ion stream to be the laminar flow and consequently to prevent the spray-back. The method is described with reference to FIG. 1. FIG. 1 illustrates a configuration in which an electrostatic atomizing device 110 having an opening 15 (air supply opening) for air supply. An arrow in FIG. 1 indicates a flow of air. Note that a description of what has been described with reference to, for example, FIG. 3 is omitted.

As illustrated in FIG. 1, the electrostatic atomizing device 110 has the opening 15. The opening 15 is provided on a surface 31 which is adjacent to a surface 30 to which the spray electrode 1 and the reference electrode 2 are provided and which is the reference electrode 2 side surface of the electrostatic atomizing device 110 which is upright. The opening 15 is in communication with the opening 12 in the electrostatic atomizing device 110.

Since the electrostatic atomizing device 110 has the opening 15, it has a path through which air is supplied from the opening 15 to the opening 12. Accordingly, air flowing into the electrostatic atomizing device 110 via the opening 15 is naturally supplied to the region in the vicinity of the opening 12 around the reference electrode 2, in which region the air pressure has been reduced by the occurrence of the ion stream. The air flowing into the electrostatic atomizing device 110 via the opening 15 causes the ion stream to be the laminar flow and consequently prevents the spray-back to the electrostatic atomizing device 110.

The opening 15 which is too small is unfavorable as being highly resistant to an air flow. Thus, the opening 15 desirably has a larger area than the opening 12. The opening 15 which is circular preferably has a diameter of 0.6 mm or more, and the opening which is elliptic preferably has a short axis with a diameter of 0.6 mm or more. This more preferably prevents the spray-back.

Note that the opening 15 does not need to be provided on the surface 31 illustrated in FIG. 1. Assuming that the electrostatic atomizing device 110 is upright, the opening 15 may be provided on an upper surface or a back surface of the electrostatic atomizing device 110, or a surface of the electrostatic atomizing device 110 which surface faces the surface 31. Further, the opening 15 is not particularly limited in shape and may be circular, rectangular, or the like.

[Effect of Preventing Spray-back]

Next, the following description discusses, with reference to the drawings, effects obtained by various configurations described above.

(Effect Obtained by Change in Size of Opening 12 Around Reference Electrode 2)

Figure 10:
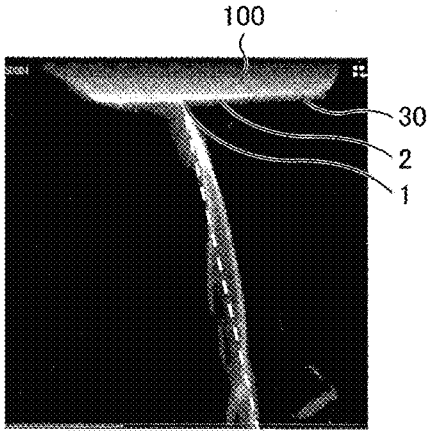
FIG. 10 illustrates how a droplet flows when the elliptic opening illustrated in FIG. 7 is used.
Figure 11:
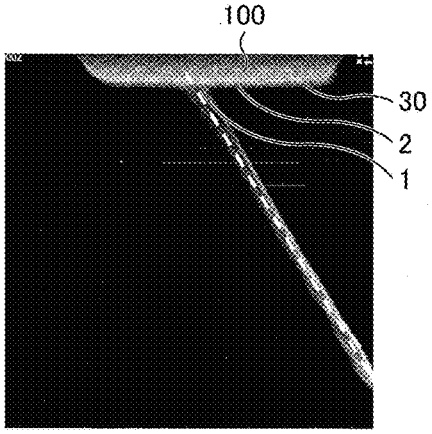
FIG. 11 illustrates how a droplet flows when the opening with the increased diameter illustrated in FIG. 4 is used.

The following description discusses, with reference to FIGS. 10 and 11, an effect obtained by changing the size of the opening 12 around the reference electrode 2. FIG. 10 illustrates how a droplet flows when the elliptic opening 12 illustrated in FIG. 7 is used. FIG. 11 illustrates how a droplet flows when the opening 12 with the increased diameter illustrated in FIG. 4 is used. Note that FIGS. 10 and 11 illustrate pictures taken with a high-speed camera from above of the electrostatic atomizing device which is upright and is in operation. In each of FIGS. 10 and 11, a broken line is drawn in a direction in which a droplet is atomized. A larger angle formed between the broken line and the surface 30 shows that the ion stream is stronger, and a smaller angle formed between the broken line and the surface 30 shows that the ion stream is weaker. This also applies to, for example, FIG. 12 described later.

By comparison of FIGS. 10 and 11, an angle formed between the broken line and the surface 30 is larger in FIG. 10 than in FIG. 11. This is because of the fact that the ion stream is high in speed because the elliptic opening of FIG. 10 is smaller in area than the opening of FIG. 11 with an increased diameter. A result of this reveals that whether the area of the opening 12 is large or small can cause a change in speed of the ion stream.

(Effect Yielded by Opening 15 for Air Supply)

Figure 12:
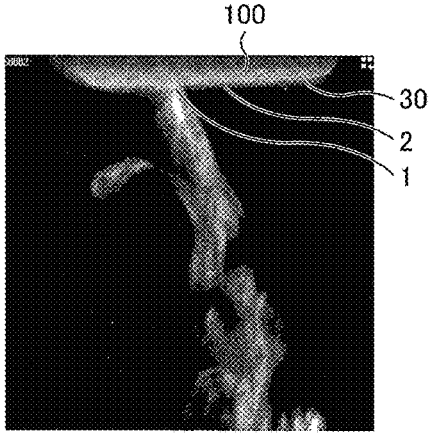
FIG. 12 illustrates how a droplet flows when the elliptic opening illustrated in FIG. 5 is used.
Figure 13:
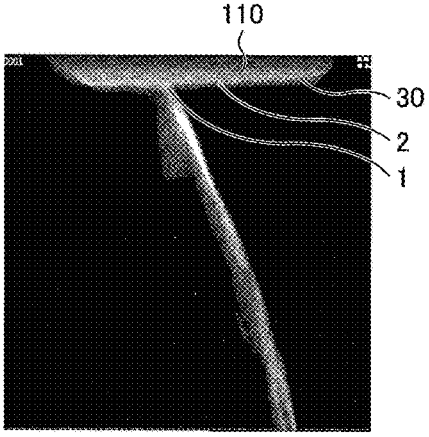
FIG. 13 illustrates how a droplet flows when the elliptic opening illustrated in FIG. 5 and the opening illustrated in FIG. 1 are used.

An effect yielded by the opening 15 for air supply is described with reference to FIGS. 12 and 13. FIG. 12 illustrates how a droplet flows when the circular opening 12 illustrated in FIG. 5 is used. FIG. 13 illustrates how a droplet flows when the circular opening 12 illustrated in FIG. 5 and the opening 15 illustrated in FIG. 1 are used.

In a case of FIG. 12 in which case the electrostatic atomizing device 100 is not provided with the opening 15 for air supply, though the ion stream is high in speed because the opening 12 has a small area, the ion stream becomes the turbulent flow, so that the atomized droplet may swirl (see FIG. 12).

Meanwhile, in a case of FIG. 13 illustrating the electrostatic atomizing device 110 having the opening 15, though the ion stream is strong because the opening 12 has a small area, the ion stream continues to be the laminar flow by the air supplied from the opening 15. This allows a greater effect of preventing the spray-back.

Figure 14:
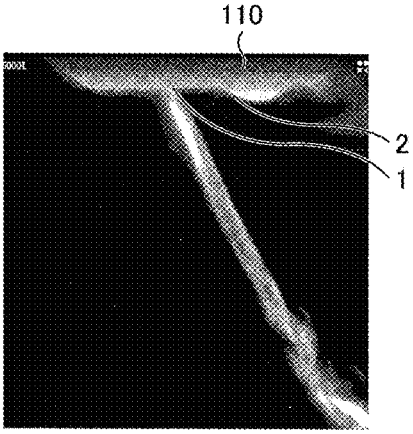
FIG. 14 illustrates a state immediately after the start of supply of smoke to an opening for air supply.
Figure 15:
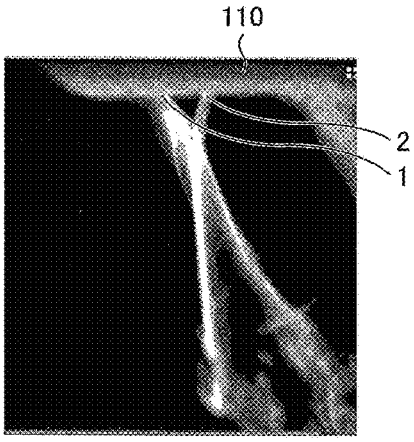
FIG. 15 illustrates a state after a time elapsed from the start of supply of smoke to an opening for air supply.

Here, in a case where the circular-shaped opening 12 illustrated in FIG. 5 and the opening 15 illustrated in FIG. 1 are used, an effect yielded by the ion stream is confirmed by sending smoke to the opening 15 and observing a flow of the smoke. FIG. 14 illustrates a state immediately after the start of supply of the smoke to the opening 15 for air supply. FIG. 15 illustrates a state after a time elapsed from the start of supply of the smoke to the opening 15 for air supply.

FIG. 14 illustrates the state immediately after the start of supply of the smoke to the opening 15 for air supply, and the smoke begins to appear from the opening 12 around the reference electrode 2. Note that the opening 12 is a circle having a diameter of 4 mm and the opening 15 is a 7.5 mm square. FIG. 15 illustrates the state after a time elapsed from the start of supply of the smoke to the opening 15 for air supply and a state in which the smoke captures a positively charged droplet. As illustrated in FIGS. 14 and 15, supply of air from the opening 15 to the opening 12 causes the ion stream to be the laminar flow. This yields an effect of preventing the spray-back to the electrostatic atomizing device 110.

Figure 16:
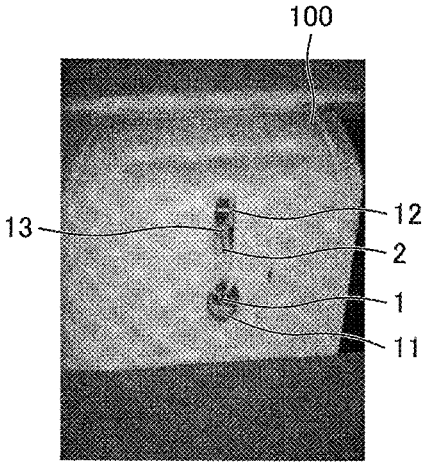
FIG. 16 illustrates a state of a spray-back when the elliptic opening illustrated in FIG. 6 is used.

Then, an effect of preventing the spray-back is described with reference to FIG. 16. FIG. 16 illustrates a state of the spray-back when the elliptic opening 12 illustrated in FIG. 6 is used. Note that the elliptic opening 12 has a length in a long axis direction of 10 mm and a length in a short axis direction of 4 mm. Note also that the reference electrode 2 is connected with an electric conductor 13 and receives a voltage from a power supply device (not shown) via the electric conductor 13.

Figure 17:
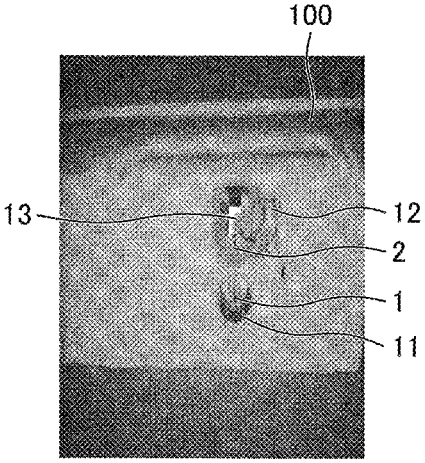
FIG. 17 illustrates a state of a spray-back when the opening with the increased diameter illustrated in FIG. 4 is used.

FIG. 17 is shown to compare an effect of preventing the spray-back with the effect described with reference to FIG. 16. FIG. 17 illustrates a state of the spray-back when the opening 12 with the increased diameter illustrated in FIG. 4 is used. However, the opening 12 is not a circle, but is a 12.5 mm×15 mm rectangle. In both of FIGS. 16 and 17, one-day atomizing experiments were carried out so as to compare amounts of droplets adhering to the electric conductor 13 exposed to outside air.

As a result, no droplet was found to adhere to the electric conductor 13 in FIG. 16, whereas a droplet was found to adhere to the electric conductor 13 in FIG. 17 (in FIG. 17, the electric conductor 13 is reflected in white, and this means that the droplet adheres to the electric conductor 13). In other words, as compared with use of the opening 12 having the increased diameter, use of the elliptic opening 12 allows a more remarkable improvement in effect of preventing the spray-back.

As described earlier, various methods can be used to prevent the spray-back. The spray-back can be prevented by various methods such as a method of changing the size and the shape of the opening 12 around the reference electrode 2, a method of supplying air from the opening 15 to the opening 12, and an appropriate combination of the methods. These methods yield an effect of realizing a device body without a great change in design of the device body and at low cost.

[Electric Charge Amount of Droplet and Size of Droplet]

[Size of Opening 12 Around Reference Electrode 2]

Figure 18:
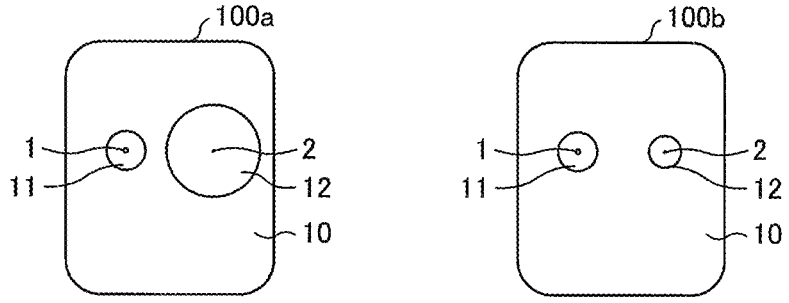
FIG. 18 illustrates a first method for controlling an electric charge amount of a droplet and a size of a droplet.

The following description discusses, with reference to FIG. 18, a method for controlling an electric charge amount of a droplet and a size of the droplet. FIG. 18 illustrates a first method for controlling the electric charge amount of the droplet and the size of the droplet.

The first method is a method for controlling the electric charge amount of the droplet and the size of the droplet in accordance with the strength of the ion stream, which strength changes depending on the size of the opening 12 around the reference electrode 2. An effect of the first method is verified by carrying out verification tests by use of two types of electrostatic atomizing devices: an electrostatic atomizing device 100*a* and an electrostatic atomizing device 100*b*.

Figure 19:
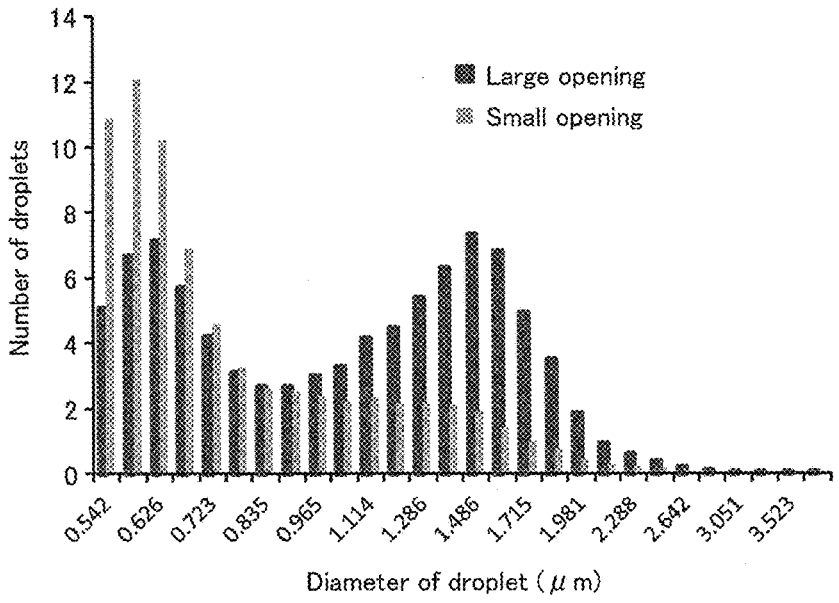
FIG. 19 is a graph showing a particle size when a diameter of an opening around a reference electrode varies.
Figure 20:
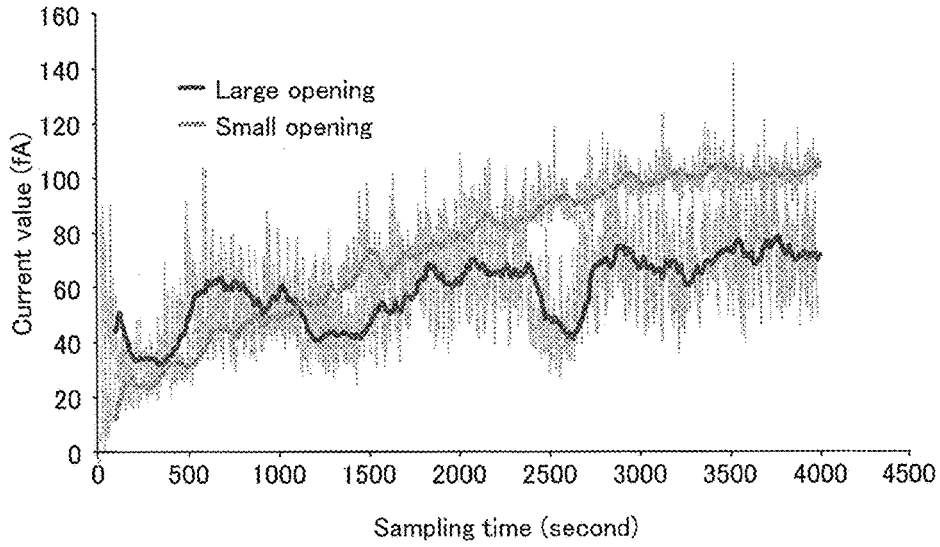
FIG. 20 is a graph showing an electric charge amount when a diameter of an opening around a reference electrode varies.

In the electrostatic atomizing device 100*a*, the opening 12 around the reference electrode 2 has a diameter which is set to be 125 times the diameter (0.1 mm) of the tip of the reference electrode 2. In the electrostatic atomizing device 100*b*, the opening 12 around the reference electrode 2 has a diameter which is set to be 40 times the diameter (0.1 mm) of the tip of the reference electrode 2. That is, the diameter of the opening 12 is set to be larger in the electrostatic atomizing device 100*a* than in the electrostatic atomizing device 100*b*. Electric charge amounts of droplets and sizes of the droplets were compared in the two types of electrostatic atomizing devices. FIGS. 19 and 20 illustrate results of the comparison.

FIG. 19 is a graph showing a particle size when the diameter of the opening 12 around the reference electrode 2 varies. In the graph of FIG. 19, a horizontal axis indicates a diameter (μm) of the droplet and a vertical axis indicates the number of droplets. FIG. 20 is a graph showing the electric charge amount when the diameter of the opening 12 around the reference electrode 2 varies. In the graph of FIG. 20, a horizontal axis indicates a sampling time (second) and a vertical axis indicates a current value (fA).

As shown in FIG. 19, the opening 12 with a smaller diameter (a small opening) was higher than the opening 12 with a larger diameter (a large opening) in ratio of droplets with a small diameter. Further, as shown in FIG. 20, the opening 12 with a smaller diameter (a small opening) was higher than the opening with a larger diameter (a large opening) in electric charge amount. A result of this may be brought about for the following reason.

In an electrostatic atomizing device, a droplet is charged, and an electric charge amount per volume of a liquid increases as the charged droplet is evaporated. When the charging is intensified, the droplet is divided into a plurality of droplets by the Coulomb force. In other words, a droplet which is large in electric charge amount is readily made small.

In this regard, the electrostatic atomizing device 100*a* is larger in the diameter of the opening 12 than the electrostatic atomizing device 100*b*. Thus, in the electrostatic atomizing device 100*a*, the ion stream generated from the opening 12 around the reference electrode 2 is weak, and a residence time of the droplet is long. Accordingly, neutralization of a positively charged droplet and negatively charged air more easily proceeds in the electrostatic atomizing device 100*a* than in the electrostatic atomizing device 100*b*. Thus, the electrostatic atomizing device 100*a* is smaller in electric charge amount of the droplet than the electrostatic atomizing device 100*b* (FIG. 20), so that the droplet is highly likely to be large in the electrostatic atomizing device 100*a* (FIG. 19).

Note that gray regions are illustrated in an upper part and a lower part of each of solid lines of FIG. 20. The gray regions indicate displacement of current values for each sampling time and each of the solid lines indicates an average value of the current values. This also applies to FIG. 23 described later.

[Influence of Opening 15 for Air Supply]

Figure 21:
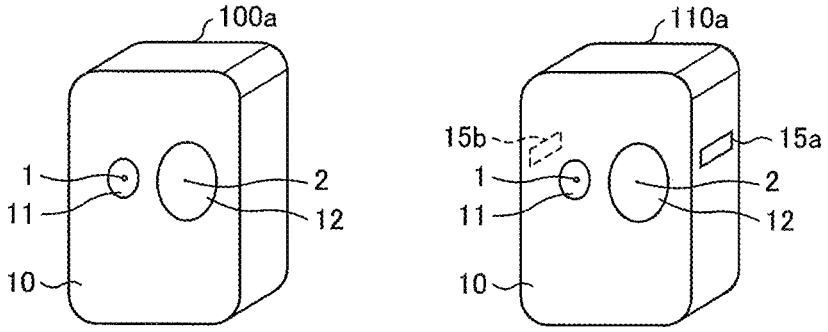
FIG. 21 is illustrates a second method for controlling an electric charge amount of a droplet and a size of a droplet.

The following description discusses, with reference to FIG. 21, a method for controlling an electric charge amount of a droplet and a size of the droplet. FIG. 21 illustrates a second method for controlling the electric charge amount of the droplet and the size of the droplet.

The second method is a method for controlling the electric charge amount of the droplet and the size of the droplet in accordance with a property of the ion stream (the turbulent flow, the laminar flow), which property changes depending on presence or absence of the opening 15. An effect of the second method is verified by use of two types of electrostatic atomizing devices: the electrostatic atomizing device 100*a* and an electrostatic atomizing device 110*a*. The electrostatic atomizing device 100*a* is identical with the electrostatic atomizing device 100*a* illustrated in FIG. 18. The electrostatic atomizing device 110*a* is obtained by causing the electrostatic atomizing device 110 illustrated in FIG. 1 to have two openings 15 which are provided so as to face each other. Reference numbers 15*a* and 15*b* are given to the respective two openings in FIG. 21. Note that the two openings each have a size of 10 mm×10 mm.

Figure 22:
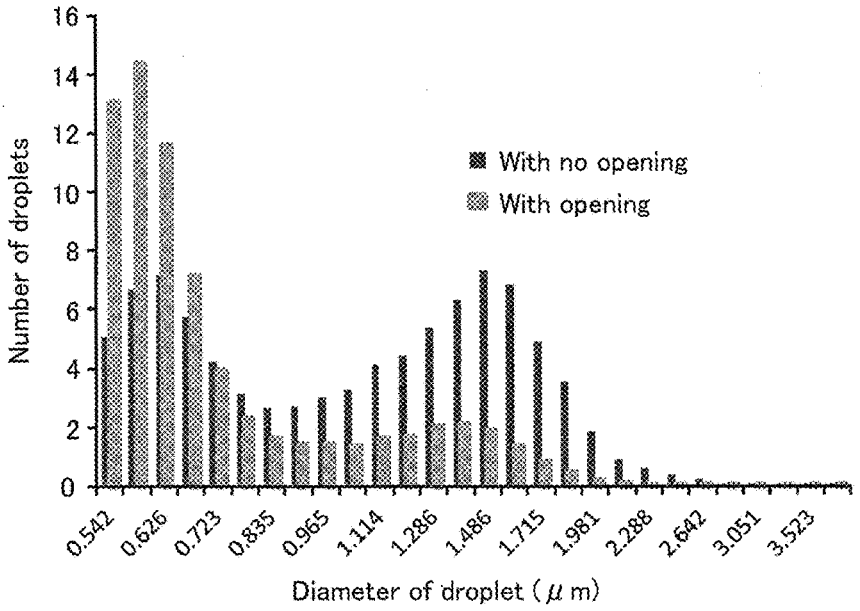
FIG. 22 is a graph showing a particle size for each of presence and absence of an opening.
Figure 23:
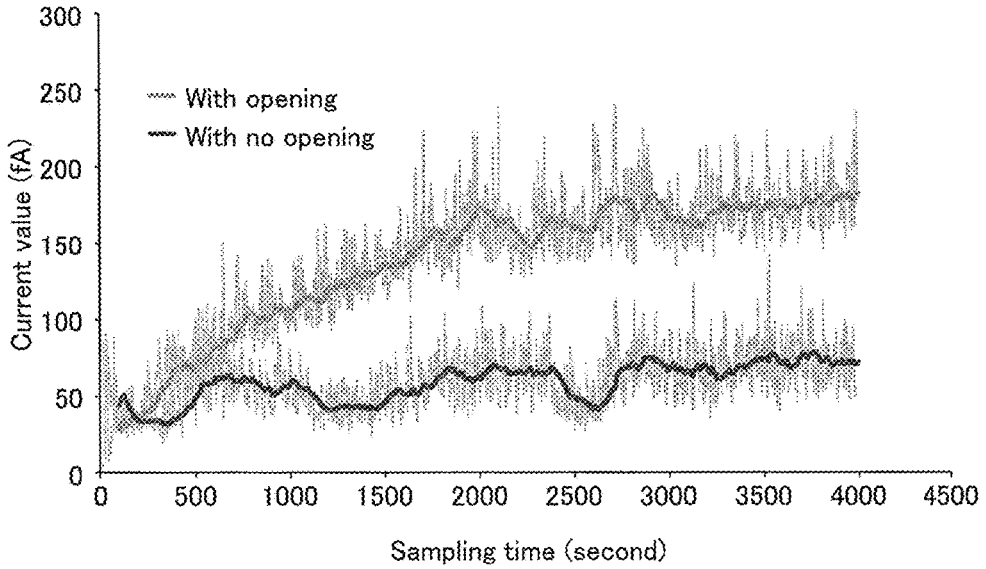
FIG. 23 is a graph showing an electric charge amount for each of presence and absence of an opening.

According to the electrostatic atomizing device 100*a*, the ion stream generated from the opening 12 around the reference electrode 2 is highly likely to be the turbulent flow as illustrated with reference to FIG. 4. Meanwhile, according to the electrostatic atomizing device 110*a*, the ion stream is highly likely to be the laminar flow by air supplied from each of the two openings 15*a* and 15*b*. Electric charge amounts of droplets and sizes of the droplets were compared in the two electrostatic atomizing devices. FIGS. 22 and 23 illustrate results of the comparison.

FIG. 22 is a graph showing a particle size for each of presence and absence of the opening 15. In the graph of FIG. 22, a horizontal axis indicates a diameter (μm) of the droplet and a vertical axis indicates the number of droplets. FIG. 23 is a graph showing the electric charge amount for each of presence and absence of the opening. In the graph of FIG. 23, a horizontal axis indicates a sampling time (second) and a vertical axis indicates a current value (fA).

As shown in FIG. 22, the electrostatic atomizing device 110*a* (with the opening) has a smaller droplet than the electrostatic atomizing device 100*a* (with no opening). Further, as illustrated in FIG. 23, the electrostatic atomizing device 100*a* (with no opening) has a smaller electric charge amount. This may occur for the following reason.

As described earlier, in an electrostatic atomizing device, a droplet is charged, and an electric charge amount per volume of a liquid increases as the droplet is evaporated. When the charging is intensified, the droplet is divided into a plurality of droplets by the Coulomb force. In other words, a droplet which is large in electric charge amount is readily made small.

In this regard, according to the electrostatic atomizing device 100*a*, the ion stream is highly likely to be the turbulent flow. Thus, neutralization of a positively charged droplet and negatively charged air more easily proceeds in the electrostatic atomizing device 100*a* than in the electrostatic atomizing device 110*a*, in which the ion stream becomes the laminar flow. Accordingly, the electrostatic atomizing device 100*a* is smaller in electric charge amount of the droplet than the electrostatic atomizing device 110*a* (FIG. 23), so that the droplet is highly likely to be large in the electrostatic atomizing device 100*a* (FIG. 22).

Further, the electrostatic atomizing device, which has the opening 15, causes the ion stream to be the laminar flow, and a particle size distribution of the droplet shifts to a left side (a small diameter side) as shown in FIG. 22. The electrostatic atomizing device 110*a* is three times larger in number of droplets with a small diameter than the electrostatic atomizing device 100*a*. Further, an average particle size is 1.2 μm in the electrostatic atomizing device 100*a*, whereas an average particle size is 0.77 μm in the electrostatic atomizing device 110*a*. Still further, the electrostatic atomizing device 110*a* greatly increases in electric charge amount of the droplet. As illustrated in FIG. 23, the electrostatic atomizing device 110*a* is three times larger in current value than the electrostatic atomizing device 100*a*.

As described earlier with reference to FIGS. 18 to 23, the size of the droplet and the electric charge amount of the droplet are controllable by adjusting the size of the opening 12 around the reference electrode 2 or depending on whether the electrostatic atomizing device has the opening 15. This allows suitable atomization in accordance with a purpose of use such as fragrance or insect-killing. Additionally, the spray-back can be prevented by adjusting the size of the opening 12 around the reference electrode 2 and providing the electrostatic atomizing device with the opening 15. This makes it possible to prevent the spray-back while controlling the size of the droplet and the electric charge amount of the droplet.

(Supplementation)

The electrostatic atomizing device of the present invention may be configured such that a first device surface or a second device surface of the device surfaces which differs from the first device surface is provided with an air supply opening for the second electrode which air supply opening is in communication with the second opening in the electrostatic atomizing device and supplies air to the second opening while the electrostatic atomizing device is driven.

An ion stream is generated from the second electrode by application of a voltage across the first electrode and the second electrode. The generation of the ion stream causes a reduction in air pressure around the second electrode. Thus, air flows in around the second electrode. Then, the ion stream and inflow air are mixed to cause the ion stream to be a turbulent flow. This turbulent flow may be a cause of the spray-back.

In this regard, the electrostatic atomizing device of the present invention, which electrostatic atomizing device has the configuration, allows air to be supplied from the air supply opening for the second electrode to the second opening while the electrostatic atomizing device is being driven, so that the ion stream can be a laminar flow. Accordingly, the electrostatic atomizing device of the present invention allows the atomized substance to be less likely to adhere to the device surface, so that the spray-back can be prevented.

The electrostatic atomizing device of the present invention may be configured such that the air supply opening for the second electrode is provided on the second device surface, and the first electrode and the second electrode are provided on the first device surface.

Assume that (i) the air supply opening for the second electrode and (ii) the first electrode and the second electrode are provided on an identical surface. In this case, the second opening at which the ion stream is generated and the air supply opening for the second electrode which air supply opening supplies air to the second opening are provided on an identical surface. Accordingly, the ion stream and inflow air are mixed to cause the ion stream to be a turbulent flow. This turbulent flow may be a cause of the spray-back.

In this regard, the electrostatic atomizing device of the present invention allows the ion stream to be the laminar flow by causing a surface on which the ion stream is generated and a surface to which air is supplied to be separate. Therefore, the electrostatic atomizing device of the present invention allows the atomized substance to be less likely to adhere to the device surface.

The electrostatic atomizing device of the present invention may be configured such that the air supply opening for the second electrode has a larger area than the second opening.

The electrostatic atomizing device of the present invention, which electrostatic atomizing device has the configuration, reduces a resistance to air supplied from the air supply opening for the second electrode to the second opening, and facilitates a flow of the air to the second opening. Accordingly, the electrostatic atomizing device of the present invention allows the ion stream to be the laminar flow and allows the atomized substance to be less likely to adhere to the device surface.

The electrostatic atomizing device of the present invention may be configured such that the first device surface, the second device surface, or a third device surface of the device surfaces which differs from each of the first device surface and the second device surface, is provided with an air supply opening for the first electrode which air supply opening is in communication with the first opening in the electrostatic atomizing device and supplies air to the first opening while the electrostatic atomizing device is driven.

The electrostatic atomizing device of the present invention, which electrostatic atomizing device has the configuration, allows air to be supplied via the air supply opening for the first electrode to the first opening around the first electrode from which first opening a substance is atomized. Accordingly, the electrostatic atomizing device of the present invention allows the substance atomized from the first electrode to ride a flow of the air, so that the atomized substance can be atomized to a distant place. Accordingly, the electrostatic atomizing device of the present invention allows the atomized substance to be less likely to adhere to the device surface.

The electrostatic atomizing device may be configured such that the air supply opening for the first electrode is provided on the second device surface or the third device surface, and the first electrode and the second electrode are provided on the first device surface.

Assume that (i) the air supply opening for the first electrode and (ii) the first electrode and the second electrode are provided on an identical surface. In this case, the first electrode from which the substance is atomized and the air supply opening for the first electrode which air supply opening supplies air to the first opening are provided on an identical surface, so that the turbulent flow occurs around the first opening. This turbulent flow may be a cause of the spray-back.

In this regard, the electrostatic atomizing device of the present invention, which electrostatic atomizing device has the configuration, allows prevention of the occurrence of the turbulent flow and allows the atomized substance to be less likely to adhere to the device surface.

The electrostatic atomizing device of the present invention may be configured such that the air supply opening for the first electrode has a larger area than the first opening.

The electrostatic atomizing device of the present invention, which electrostatic atomizing device has the configuration, reduces a resistance to air supplied from the air supply opening for the first electrode to the first opening and facilitates a flow of the air to the first opening. Accordingly, the electrostatic atomizing device of the present invention allows prevention of the occurrence of the turbulent flow in a region in which the substance is atomized, and allows the atomized substance to be less likely to adhere to the device surface.

The electrostatic atomizing device of the present invention may be configured such that: the second electrode is needle-shaped, and the second opening is circular; and the second opening has a diameter which is smaller than at least either one of 25 times a diameter of a body of the second electrode and 150 times a diameter of a tip of the second electrode.

The electrostatic atomizing device of the present invention may be configured such that: the second electrode is needle-shaped, and the second opening is circular; and the second opening has a diameter which is 5 times to 9 times a diameter of a body of the second electrode or a diameter which is 25 times to 45 times a diameter of a tip of the second electrode.

The electrostatic atomizing device of the present invention, which electrostatic atomizing device has the configuration, allows most of the droplet atomized from the first electrode to ride the ion stream and allows the atomized substance to be less likely to adhere to the device surface.

The electrostatic atomizing device of the present invention may be configured such that: the second opening is shaped to have an ellipse; and the ellipse has a short axis which is positioned so as to substantially align with a line segment connecting the first electrode and the second electrode.

The electrostatic atomizing device of the present invention, which electrostatic atomizing device has the configuration, allows most of the droplet atomized from the first electrode to ride the ion stream and allows the atomized substance to be less likely to adhere to the device surface. Note that strength of the ion stream can be optimized by changing a width of the short axis of the ellipse.

The above description has discussed various modes of the electrostatic atomizing device of the present embodiment. It is naturally possible to combine those modes, which merely show an example of the present embodiment.

The present invention is not limited to the description of the embodiments above, but may be altered within the scope of the claims. An embodiment based on a combination of technical means properly altered within the scope of the claims is encompassed in the technical scope of the present invention.

INDUSTRIAL APPLICABILITY

The present invention is suitably applicable to an electrostatic atomizing device.

REFERENCE SIGNS LIST

1 Spray electrode (first electrode)
2 Reference electrode (second electrode)
3 Power supply device
6 Spray electrode fixing part
7 Reference electrode fixing part
10 Dielectric
11 Opening (first opening)
12 Opening (second opening)
15 Opening (air supply opening)
13 Electric conductor
100, 110 Electrostatic atomizing device

The invention claimed is:

1. An electrostatic atomizing device comprising:
a first electrode and a second electrode across which and the first electrode a voltage is applied,
the first electrode for atomizing a substance from a tip thereof,
the first electrode and the second electrode being provided in a first opening and a second opening which are provided on a first device surface of device surfaces of the electrostatic atomizing device, respectively, and
the first electrode and the second electrode are provided in parallel with each other,
wherein the first device surface or a second device surface of the device surfaces which differs from the first device surface is provided with an air supply opening for the second electrode which air supply opening is in communication within the device with the second opening in the electrostatic atomizing device but not the first opening in the electrostatic atomizing device and supplies air to the second opening while the electrostatic atomizing device is being driven,
a dielectric, and
a power supplying device applying a voltage across the electrodes to form an electric field between the electrodes and cause an electric dipole inside the dielectric,
wherein the air supply opening for the second electrode has a larger area than the second opening, and wherein the air supply opening for the second electrode includes an opening on a third device surface of the device surfaces, which differs from each of the first device surface and the second device surface.

2. The electrostatic atomizing device according to claim 1, wherein the air supply opening for the second electrode is provided on the second device surface.

3. The electrostatic atomizing device according to claim 1, wherein the first device surface, the second device surface, the third device surface, or a fourth device surface of the device surfaces which differs from each of the first device surface, the second device surface, and the third device surface is provided with an air supply opening for the first electrode which air supply opening is in communication with the first opening in the electrostatic atomizing device and supplies air to the first opening while the electrostatic atomizing device is being driven.

4. The electrostatic atomizing device according to claim 3, wherein the air supply opening for the first electrode is provided on the second device surface, the third device surface, or the fourth device surface.

5. The electrostatic atomizing device according to claim 3, wherein the air supply opening for the first electrode has a larger area than the first opening.

6. The electrostatic atomizing device according to claim 1, wherein:
the second electrode is needle-shaped, and the second opening is circular; and
the second opening has a diameter which is smaller than at least either one of 25 times a diameter of a body of the second electrode and 150 times a diameter of a tip of the second electrode.

7. The electrostatic atomizing device according to claim 1, wherein:
the second electrode is needle-shaped, and the second opening is circular; and
the second opening has a diameter which is 5 times to 9 times a diameter of a body of the second electrode or a diameter which is 25 times to 45 times a diameter of a tip of the second electrode.

8. The electrostatic atomizing device according to claim 1, wherein:
the second opening is shaped to have an ellipse; and
the ellipse has a short axis which is positioned so as to align with a line segment connecting the first electrode and the second electrode.

9. The electrostatic atomizing device according to claim 1, wherein the dielectric comprises a composition selected from the group consisting of nylon 6, nylon 11, nylon 12, polypropylene, nylon 66, a polyacetyl-polytetrafluoroethylene mixture, and mixtures thereof.

* * * * *